US009589504B2

(12) United States Patent
Qing et al.

(10) Patent No.: US 9,589,504 B2
(45) Date of Patent: Mar. 7, 2017

(54) OLED AC DRIVING CIRCUIT, DRIVING METHOD AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 26 days.

(21) Appl. No.: 14/366,893

(22) PCT Filed: Nov. 1, 2013

(86) PCT No.: PCT/CN2013/086449
§ 371 (c)(1),
(2) Date: Jan. 23, 2015

(87) PCT Pub. No.: WO2015/010385
PCT Pub. Date: Jan. 29, 2015

(65) Prior Publication Data

US 2016/0125803 A1 May 5, 2016

(30) Foreign Application Priority Data

Jul. 25, 2013 (CN) ..... 2013 1 0317705

(51) Int. Cl.
*G09G 3/32* (2016.01)

(52) U.S. Cl.
CPC ... *G09G 3/3233* (2013.01); *G09G 2300/0426* (2013.01); *G09G 2300/0443* (2013.01);
(Continued)

(58) Field of Classification Search
CPC ..... H01L 27/3244; G09G 3/3233
See application file for complete search history.

(56) References Cited

U.S. PATENT DOCUMENTS 4,528,480 A * 7/1985 Unagami ..... G09G 3/30 257/296
5,386,179 A * 1/1995 Sato ..... G09G 3/30 257/365

(Continued)

FOREIGN PATENT DOCUMENTS

CN 101123065 A 2/2008
CN 102222468 A 10/2011

(Continued)

OTHER PUBLICATIONS

International Search Report dated Mar. 14, 2014; PCT/CN2013/086449.

(Continued)

*Primary Examiner* — Dorothy Harris
(74) *Attorney, Agent, or Firm* — Ladas & Parry LLP

(57) ABSTRACT

An OLED AC driving circuit, a driving method and a display device are disclosed in the present disclosure. The OLED AC driving circuit includes a light-emitting control unit, a charging unit, a driving unit, a first storage unit, a second storage unit, a first light-emitting unit, a second light-emitting unit, a first voltage control unit and a second voltage control unit. The present disclosure employs the first light-emitting unit and the second light-emitting unit which are connected reversely with each other to make the first light-emitting unit and the second light-emitting unit emit (Continued)

light alternately during two adjacent frames. In one frame, only one light-emitting unit emits light for display while the other one is reversely biased. When the next frame comes, the two units exchange their operating states. The AC driving of the light-emitting units is realized, thus improving the energy utilization efficiency. The cause of the aging of the light-emitting unit is removed completely, and the lifespan of the light-emitting unit is extended largely. The influence of the internal resistance of the lines on the light-emitting current is eliminated, and the display quality of pictures is improved.

15 Claims, 5 Drawing Sheets

(52) U.S. Cl.
CPC ..... *G09G 2300/0852* (2013.01); *G09G 2310/0254* (2013.01); *G09G 2310/0272* (2013.01); *G09G 2310/0291* (2013.01); *G09G 2320/043* (2013.01); *G09G 2330/021* (2013.01)

(56) References Cited

U.S. PATENT DOCUMENTS 6,900,785 B2 * 5/2005 Kimura ..... G09G 3/3233 315/169.3
7,973,483 B2 * 7/2011 Shin ..... G09G 3/2022 315/169.3
9,030,388 B2 * 5/2015 Qi ..... G09G 3/3233 315/169.3
9,269,299 B2 * 2/2016 Tan ..... G09G 3/3208
2002/0047839 A1 * 4/2002 Kasai ..... G09G 3/3233 345/211
2002/0180671 A1 * 12/2002 Inukai ..... G09G 3/2011 345/76
2002/0190661 A1 * 12/2002 Duggal ..... H01L 27/3204 315/169.1
2004/0012336 A1 * 1/2004 Okuda ..... G09G 3/3216 315/169.1
2005/0133783 A1 * 6/2005 Yamazaki ..... H01L 27/3244 257/40
2006/0125737 A1 * 6/2006 Kwak ..... G09G 3/3233 345/76
2006/0169979 A1 * 8/2006 Endo ..... G09G 3/3233 257/59
2006/0214596 A1 * 9/2006 Miller ..... G09G 3/3233 315/169.3
2008/0036706 A1 2/2008 Kitazawa
2008/0238328 A1 * 10/2008 Shin ..... G09G 3/2022 315/169.3
2009/0135166 A1 * 5/2009 Uchino ..... G09G 3/006 345/205
2012/0306374 A1 * 12/2012 Lee ..... H05B 33/0896 315/121
2014/0070725 A1 * 3/2014 Qi ..... G09G 3/3233 315/291
2015/0116191 A1 * 4/2015 Qi ..... G09G 3/3233 345/76
2015/0269886 A1 * 9/2015 Tan ..... G09G 3/3208 345/698
2015/0287359 A1 * 10/2015 Qing ..... G09G 3/3233 345/214
2015/0325169 A1 * 11/2015 Qing ..... G09G 3/3225 345/214
2016/0019836 A1 * 1/2016 Qing ..... G09G 3/3233 345/76

FOREIGN PATENT DOCUMENTS

CN 103021336 A 4/2013
CN 103366682 A 10/2013
CN 203325414 U 12/2013

OTHER PUBLICATIONS

Written Opinion of the International Searching Authority dated Mar. 18, 2013; PCT/CN2013086449.
First Chinese Office Action dated Nov. 15, 2014; Appln. No. 201310317705.1.

* cited by examiner

OLED AC DRIVING CIRCUIT, DRIVING METHOD AND DISPLAY DEVICE

TECHNICAL FIELD OF THE DISCLOSURE

The present disclosure relates to the technical field of display, and particularly to an Organic Light Emitting Diode (OLED) AC (alternate current) driving circuit, a driving method and a display device.

BACKGROUND

OLED is driven by a current generated by a driving transistor in a saturation state to emit light. Currently, OLED faces lots of problems mainly including the following.

First, the Low Temperature Poly Silicon (LTPS) process as the main stream manufacturing technology of the OLED driving circuit has very poor uniformity of transistor threshold voltages $V_{th}$ in the manufacturing procedure, so that different transistor threshold voltages $V_{th}$ would generate different driving currents with the same input gray-scale voltage, resulting in non-uniformity of the driving currents. In addition to compensating for the differences between the transistor threshold voltages $V_{th}$ in the LTPS process in the driving circuit, improving the process is also a solution. For example, the oxide thin-film transistor as a very promising panel driving device can obtain very good uniformity in the manufacturing procedure, and can solve the problem of the non-uniformity of threshold voltages. Another factor affecting the uniformity of brightness is internal resistance. Since the lines have internal resistance and OLEDs are light emitting devices driven by currents, as long as there are currents passing through the lines, there must be voltage drops in the lines, directly resulting that power supply voltages at different positions cannot reach the required voltage.

Second, OLED involves the aging problem which is a common problem that all displays based on OLED emitting must face. Since DC (direct current) driving is mostly used in the prior art, the transport directions of holes and electrons do not change, and the holes and electrons are injected into the light emitting layer from the anode and the cathode respectively to form excitons in the light emitting layer to emit light through irradiation. The remaining holes (or electrons) which are not involved in recombination may accumulate at the hole transport layer/light emitting layer interface (or the light emitting layer/electron transport layer interface) or flow into the electrodes over the potential barrier. With the increasing of the usage time of the OLED, lots of un-recombined carriers (including holes and electrons) accumulated at the internal interfaces of the light emitting layer build a built-in electric field inside the OLED, causing the threshold voltage $V_{th_oled}$ of the OLED to increase constantly, the illumination brightness of the OLED to drop constantly, and the energy utilization efficiency to decrease gradually.

SUMMARY

I. Technical Problem to be Solved

The technical problem to be solved by the present disclosure is how to provide an OLED AC driving circuit, a driving method and a display device to solve the display non-uniformity caused by the light emitting of the OLED and the aging problem of the OLED.

II. Technical Solutions

In order to solve the above problem, according to one aspect of the present disclosure, there is provided an OLED AC driving circuit comprising a light-emitting control unit, a charging unit, a driving unit, a first storage unit, a second storage unit, a first light-emitting unit, a second light-emitting unit, a first voltage control unit and a second voltage control unit.

The light-emitting control unit is connected to the driving unit, the second storage unit and the first voltage control unit, and is configured to control the first light-emitting unit or the second light-emitting unit under the control of a light-emitting control signal.

The charging unit is connected to the driving unit, the first storage unit, the second storage unit, the first light-emitting unit, the second light-emitting unit and the second voltage control unit, and is configured to charge the first storage unit or the second storage unit under the control of a scan signal and a data signal.

The driving unit is connected to the first storage unit, the second storage unit, the first light-emitting unit and the second light-emitting unit, and is configured to drive the first light-emitting unit or the second light-emitting unit to emit light.

The first storage unit is connected to the first light-emitting unit, the second light-emitting unit, the driving unit and the charging unit, and is configured to store the data signal or turn on the driving unit.

The second storage unit is connected to the first voltage control unit and the driving unit, and is configured to store the data signal or turn on the driving unit.

The first light-emitting unit is connected to the second voltage control unit, and is configured to emit light under the control of the first voltage control unit, the second voltage control unit, the charging unit and the driving unit.

The second light-emitting unit is connected to the second voltage control unit, and is configured to emit light under the control of the first voltage control unit, the second voltage control unit, the charging unit and the driving unit.

The first voltage control unit is connected to the light-emitting control unit and the second storage unit, and is configured to supply power to the second storage unit and the first light-emitting unit.

The second voltage control unit is connected to the charging unit, the first light-emitting unit and the second light-emitting unit, and is configured to supply power to the first storage unit and the second light-emitting unit.

Further, the light-emitting control unit comprises a first transistor having the gate configured to receive the light-emitting control signal, the source connected to the first voltage control unit, and the drain connected to the driving unit.

Further, the driving unit comprises a driving transistor having the gate connected to a first terminal of the first storage unit and a first terminal of the second storage unit, and the source and drain connected to the light-emitting control unit and a second terminal of the first storage unit respectively.

Further, the charging unit comprises: a second transistor having the gate configured to receive the scan signal, the source connected to the drain of the driving transistor, and the drain connected to the second voltage control unit; and a third transistor having the gate configured to receive the scan signal, the source configured to receive the data signal, and the drain connected to the gate of the driving transistor.

Further, the first storage unit comprises a first capacitor the two terminals of which are connected to the source of the second transistor and the drain of the third transistor respectively.

Further, the second storage unit comprises a second capacitor the two terminals of which are connected to the light-emitting control unit and the gate of the driving transistor respectively.

Further, the first light-emitting unit comprises a first light-emitting device having the anode connected to the drain of the driving transistor and the cathode connected to the second voltage control unit.

Further, the second light-emitting unit comprises a second light-emitting device having the cathode connected to the drain of the driving transistor and the anode connected to the second voltage control unit.

Further, the light-emitting control unit, the charging unit and the driving transistor are N-type transistors or P-type transistors.

According to another aspect of the present disclosure, there is provided a display device comprising the OLED AC driving circuit as described in the above.

According to yet another aspect of the present disclosure, there is provided a driving method of the OLED AC driving circuit, comprising: charging the first storage unit; controlling the first light-emitting unit to emit light; charging the second storage unit; and controlling the second light-emitting unit to emit light.

Further, in the driving method, said charging the first storage unit comprises: controlling the scan signal to be at a high level to turn on the charging unit, and controlling the light-emitting control signal to be at a low level to turn off the light-emitting control unit; and controlling an output voltage of the first voltage control unit to become a high level from a low level, and controlling an output voltage of the second voltage control unit to become a low level from a high level so as to charge the first storage unit.

Said controlling the first light-emitting unit to emit light comprises: controlling the scan signal to be at a low level to turn off the charging unit, and controlling the light-emitting control signal to be at a high level to turn on the light-emitting control unit; and controlling the output voltage of the first voltage control unit to be at a high level and controlling the output voltage of the second voltage control unit to be at a low level, so as to make the first light-emitting unit emit light.

Said charging the second storage unit comprises: controlling the scan signal to be at a high level to turn on the charging unit, and controlling the light-emitting control signal to be at a low level to turn off the light-emitting control unit; and controlling the output voltage of the first voltage control unit to become a low level from a high level, and controlling the output voltage of the second voltage control unit to become a high level from a low level so as to charge the second storage unit.

Said controlling the second light-emitting unit to emit light comprises: controlling the scan signal to be at a low level to turn off the charging unit, and controlling the light-emitting control signal to be at a high level to turn on the light-emitting control unit; and controlling the output voltage of the first voltage control unit to be at a low level and controlling the output voltage of the second voltage control unit to be at a high level, so as to make the second light-emitting unit emit light.

III. Advantageous Effects

1. The present disclosure controls to turn on the second transistor and the third transistor and turn off the first transistor and the driving transistor, and adjusts the electrical level of the first voltage control unit and the second voltage control unit to charge the first capacitor or the second capacitor by the data signal. The voltage kept at the first capacitor or the second capacitor is the gate-source voltage of the driving transistor, and the terminal of the capacitor connected to the data line is at the floating state during the light-emitting procedure, such that the voltage between the two terminals of the capacitor keeps constant and is not influenced by the internal resistance of the lines. Therefore, the non-uniformity problem of the OLED light-emitting display caused by the internal resistance of the lines is overcome during the light-emitting procedure, and the display quality of pictures is improved.

2. The present disclosure diminishes the built-in field built inside the OLED by the remaining carriers in the OLED, improves the injection and recombination of carriers, improves the recombination efficiency of the carriers and holes inside the OLED, and extends the usage life of the OLED through the alternate change of the electrical levels of the first voltage control unit and the second voltage control unit.

3. The present disclosure has a simple circuit structure and is suitable for thin film transistors manufactured by the process of amorphous silicon, poly silicon, oxide, and so on. The circuit can be easily operated, and is easily applied to large scale manufacture and application.

DETAILED DESCRIPTION

Hereinafter, specific implementations of the present disclosure will be further described in detail in connection with drawings and embodiments. The following embodiments are used to illustrate the present disclosure, but not to limit the scope of the present disclosure.

In order to solve the display non-uniformity caused by the light emitting of the OLED and the aging problem of the OLED, an OLED AC driving circuit, a driving method and a display device are proposed in the present disclosure.

First Embodiment

Figure 1:
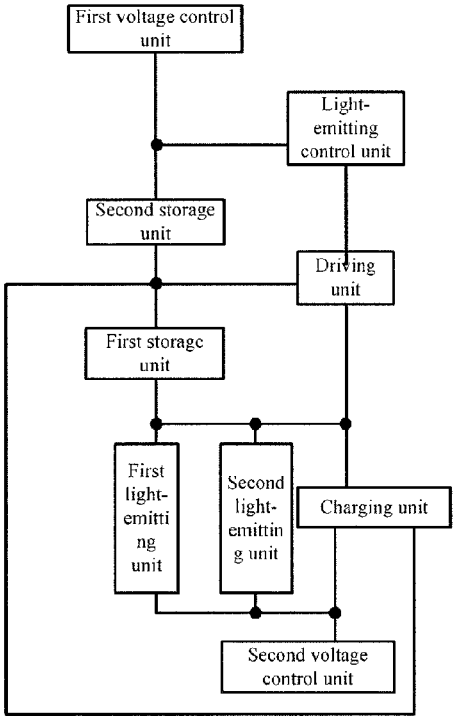
FIG. 1 is a circuit diagram of an OLED AC driving circuit according to an embodiment of the present disclosure.

An OLED AC driving circuit as shown in FIG. 1 according to the embodiment of the present disclosure comprises a light-emitting control unit, a charging unit, a driving unit, a first storage unit, a second storage unit, a first light-emitting unit, a second light-emitting unit, a first voltage control unit and a second voltage control unit.

The light-emitting control unit is connected to the driving unit, the second storage unit and the first voltage control unit, and is configured to control the first light-emitting unit or the second light-emitting unit under the control of a light-emitting control signal.

As an example, the light-emitting unit can comprise a first transistor. The gate of the first transistor is connected with the light-emitting control signal, the source of the first transistor is connected to the first voltage control unit, and the drain of the first transistor is connected to the driving unit.

The driving unit is connected to the first storage unit, the second storage unit, the first light-emitting unit and the second light-emitting unit, and is configured to drive the first light-emitting unit or the second light-emitting unit.

As an example, the driving unit can comprise a driving transistor. The gate of the driving transistor is connected to a first terminal of the first storage unit and a first terminal of the second storage unit, and the source and drain of the driving transistor are connected to the light-emitting control unit and a second terminal of the first storage unit, respectively. In particular, the source of the driving transistor is connected to a second terminal of the second storage unit through the light-emitting control unit. As described in the above, the source and drain of the driving transistor are interchangeable.

The charging unit is connected to the driving unit, the first storage unit, the second storage unit, the first light-emitting unit, the second light-emitting unit and the second voltage control unit, and is configured to charge the first storage unit or the second storage unit under the control of a scan signal and a data signal.

As an example, the charging unit can comprise a second transistor and a third transistor.

The gate of the second transistor is configured to receive the scan signal, the source of the second transistor is connected to the drain of the driving transistor, and the drain of the second transistor is connected to the second voltage control unit.

The gate of the third transistor is configured to receive the scan signal, the source of the third transistor is configured to receive the data signal, and the drain of the third transistor is connected to the gate of the driving transistor.

The first storage unit is connected to the first light-emitting unit, the second light-emitting unit, the driving unit and the charging unit, and is configured to store the data signal or turn on the driving unit. In particular, the first storage unit is connected to the second voltage control unit through the charging unit when being charged, and is configured to storage the data signal; and the first storage unit is connected to the second voltage control unit through the first light-emitting unit or the second light-emitting unit when turning on the driving unit.

As an example, the first storage unit can comprise a first capacitor, and two terminals of the first capacitor are connected to the source of the second transistor and the drain of the third transistor, respectively.

The second storage unit is connected to the first voltage control unit and the driving unit, and is configured to store the data signal or turn on the driving unit.

As an example, the second storage unit can comprise a second capacitor, and two terminals of the second capacitor are connected to the light-emitting control unit and the gate of the driving transistor, respectively.

The first light-emitting unit is connected to the second voltage control unit, and is configured to emit light under the control of the first voltage control unit, the second voltage control unit, the charging unit and the driving unit.

As an example, the first light-emitting unit can comprise a first light-emitting device, and the anode of the first light-emitting device is connected to the drain of the driving transistor and the cathode of the first light-emitting device is connected to the second voltage control unit.

The second light-emitting unit is connected to the second voltage control unit, and is configured to emit light under the control of the first voltage control unit, the second voltage control unit, the charging unit and the driving unit.

As an example, the second light-emitting unit can comprise a second light-emitting device, and the cathode of the second light-emitting device is connected to the drain of the driving transistor and the anode of the second light-emitting device is connected to the second voltage control unit.

The first voltage control unit is connected to the light-emitting control unit and the second storage unit, and is configured to supply power to the second storage unit and the first light-emitting unit.

The second voltage control unit is connected to the charging unit, the first light-emitting unit and the second light-emitting unit, and is configured to supply power to the first storage unit and the second light-emitting unit.

The first light-emitting device and the second light-emitting device are organic light-emitting diodes.

The first transistor of the light-emitting control unit, the second transistor and the third transistor of the charging unit and the driving transistor are N-type transistors or P-type transistors.

Figure 2:
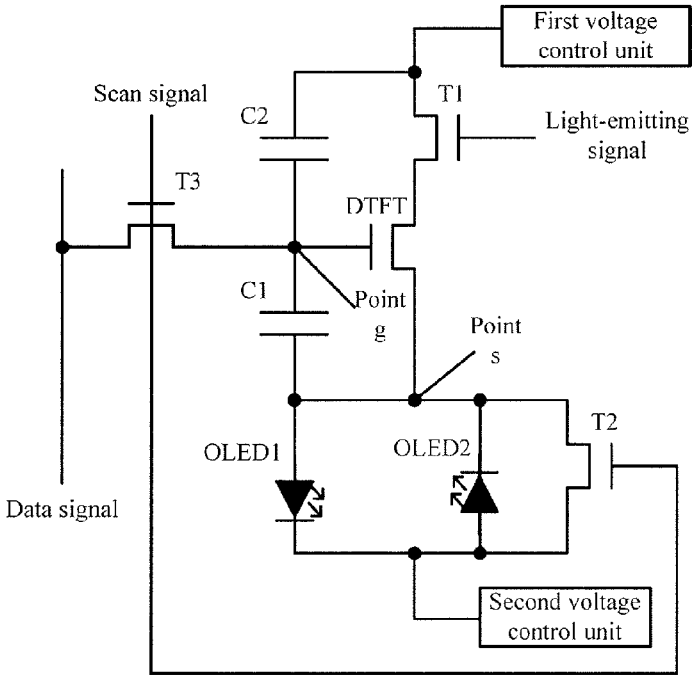
FIG. 2 is an exemplary practical circuit diagram of an OLED AC driving circuit according to an embodiment of the present disclosure.

A practical circuit diagram of the present disclosure is shown in FIG. 2. In the embodiment, the light-emitting control unit, the charging unit and the driving unit are all implemented by transistors, and correspond to the first transistor, the second transistor, the third transistor and the driving transistor, respectively. The first transistor is the light-emitting control unit. The second transistor and the third transistor constitute the charging unit. The driving transistor is the driving unit. The description is made by taking the light-emitting control unit, the charging unit and the driving transistor being N-type transistors as an example.

As shown in FIG. 2, the OLED AC driving circuit comprises the first transistor T1, the second transistor T2, the third transistor T3, the driving transistor DTFT, the first capacitor C1, the second capacitor C2, the first light-emitting device OLED1, the second light-emitting device OLED2, the first voltage control unit and the second voltage control unit.

The gate of the first transistor T1 is configured to receive the light-emitting control signal, the source of the first transistor T1 is connected to the first voltage control unit, and the drain of the first transistor T1 is connected to the source of the driving transistor DTFT.

The gate of the driving transistor DTFT is connected to the drain of the third transistor T3, and the drain of the driving transistor DTFT is connected to the source of the second transistor T2, the anode of the first light-emitting device OLED1 and the cathode of the second light-emitting device OLED2.

The drain of the second transistor T2, the cathode of the first light-emitting device OLED1 and the anode of the second light-emitting device OLED2 are connected to the second voltage control unit. The source of the third transistor T3 is configured to receive the data signal. The gate of the second transistor T2 and the gate of the third transistor T3 are configured to receive the scan signal.

The two terminals of the first capacitor C1 are connected to the gate of the driving transistor DTFT and the drain of the driving transistor DTFT, respectively. The two terminals of the second capacitor C2 are connected to the source of the first transistor T1 and the gate of the driving transistor DTFT, respectively.

The first light-emitting device OLED1 and the second light-emitting device OLED2 are organic light-emitting diodes.

The first transistor T1, the second transistor T2, the third transistor T3 and the driving transistor DTFT are N-type transistors.

The scan signal is configured to turn on the third transistor T3, such that the data signal is loaded to the first capacitor C1 or the second capacitor C2.

The light-emitting control signal is configured to turn on the first transistor T1, so as to control the first light-emitting device OLED1 or the second light-emitting device OLED2 to emit light.

Second Embodiment

In the embodiment of the present disclosure, there is also provided a display device comprising the OLED AC driving circuit as described in the above first embodiment.

Third Embodiment

In the following, a driving method of the OLED AC driving circuit will be described by taking the driving circuit structure described in the first embodiment as an example.

Figure 3:
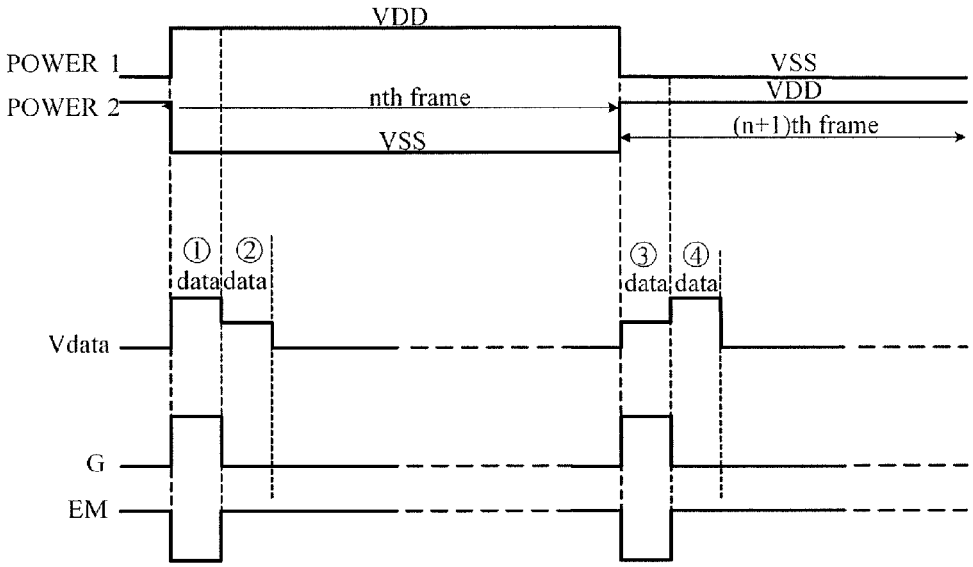
FIG. 3 is a timing chart corresponding to a practical circuit diagram according to the present disclosure.

The method will be described with reference to the timing chart (FIG. 3) corresponding to the practical circuit diagram of the present disclosure. In FIG. 3, POWER1 is a waveform of an output voltage of the first voltage control unit, POWER2 is a waveform of an output voltage of the second voltage control unit, Vdata is a waveform of the data signal, G is a waveform of the scan signal, EM is a waveform of the light-emitting control signal, and n represents the $n^{th}$ frame.

Corresponding operations can be divided into the following stages.

1. A charging stage of the first storage unit in which the first storage unit (the first capacitor C1) is charged The scan signal is at the high level and the charging unit is turned on. The light-emitting control signal is at the low level and the light-emitting control unit is turned off. The output voltage of the first voltage control unit becomes the high level from the low level and the output voltage of the second voltage control unit becomes the low level from the high level so as to charge the first storage unit (the first capacitor C1).

Figure 4:
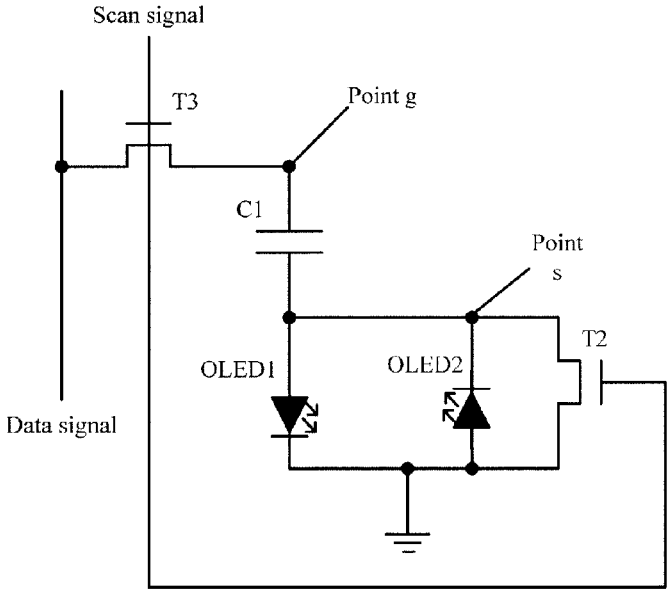
FIG. 4 is an equivalent circuit diagram for charging a first capacitor according to the present disclosure.

Referring to FIG. 2 and FIG. 3, the scan signal is at the high level, and the second transistor T2 and the third transistor T3 are turned on. The light-emitting control signal is at the low level, and the first transistor T1 is turned off. The output voltage of the first voltage control unit becomes the high level from the low level. The output voltage of the second voltage control unit becomes the low level from the high level. The data signal is a data voltage to charge the first capacitor C1. The equivalent circuit diagram for charging the first capacitor C1 at this stage is shown in FIG. 4.

Since the second transistor T2 is turned on, the first light-emitting device OLED1 and the second light-emitting device OLED2 are short-circuited, and the voltage at point s is at the low level $V_{SS}$. Since the first transistor T1 is turned off, no current flows through the driving transistor DTFT, and thus no voltage drop generated by current exists at the point s. The point s is at the voltage value designed for the power supply, and thus the voltage difference between the two terminals of the first capacitor C1 after charged is not influenced by the internal resistance. Therefore, the voltage $V_{C1}$ between the two terminals of the first capacitor C1 after charged is:

$$V_{C1}=V_{data}-V_{SS}$$

where $V_{data}$ is the data voltage of the data signal.

2. A light-emitting stage of the first light-emitting unit in which the first light-emitting unit (the first light-emitting device OLED1) is controlled to emit light The scan signal is at the low level, and the charging unit is turned off. The light-emitting control signal is at the high level, and the light-emitting control unit is turned on. The output voltage of the first voltage control unit is at the high level and the output voltage of the second voltage control unit is at the low level, so as to make the first light emitting unit (the first light emitting device OLED1) emit light.

Figure 5:
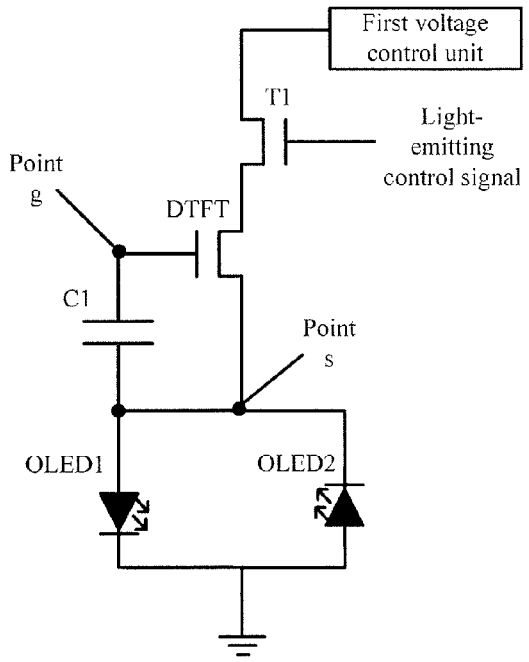
FIG. 5 is an equivalent circuit diagram for controlling a first light-emitting device to emit light according to the present disclosure.

Referring to FIG. 2 and FIG. 3, the scan signal is at the low level, and the second transistor T2 and the third transistor T3 are turned off. The light-emitting control signal is at the high level, and the first transistor T1 is turned on. The output voltage of the first voltage control unit is at the high level and the output voltage of the second voltage control unit is at the low level, so as to make the first light-emitting device OLED1 emit light. The equivalent circuit diagram for controlling the first light-emitting device to emit light at this stage is shown in FIG. 5.

The voltages of the first voltage control unit and the second voltage control unit remain unchanged. At this stage, the first light-emitting device OLED1 begins to enter a positive half period of the AC driving from this point, and will stay in the positive half period of the AC driving, i.e. the operating state, during the light-emitting stage of the first light-emitting unit. Since the gate of the driving transistor DTFT is at a floating state, as shown in the above, since the source and the drain of the driving transistor DTFT are interchangeable, as now shown in FIG. 2, the electrode of the driving transistor DTFT connected to the point s is used as the source, the electrode of the driving transistor DTFT connected to T1 is used as the drain, and thus the gate-source voltage of the driving transistor DTFT is the voltage between the two terminals of the first capacitor C1. Therefore, $$V_{gs}=V_{C1}=V_{data}-V_{SS}$$

where $V_{gs}$ is the voltage between the point g and the point s.

The driving current through the driving transistor DTFT, i.e. the light-emitting current $I_{oled1}$ of the first light-emitting device OLED1, is $$I_{oled1}=k_d(V_{gs}-V_{thd})^2=k_d(V_{data}-V_{SS}-V_{thd})^2$$

where $k_d$ is a constant related to the process and the driving design, and $V_{thd}$ is the threshold voltage of the driving transistor DTFT. The driving current is influenced by the data voltage $V_{data}$ of the data signal and the threshold voltage $V_{thd}$ of the driving transistor, which is a problem for the LTPS process with poor electric uniformity, but is not a main problem for the oxide thin-film field effect transistor TFT since the threshold voltages of the oxide TFTs are uniform and the threshold values of the oxide TFTs do not differ a lot for the oxide TFTs at all points.

In addition, for the second light-emitting device OLED2, beginning from this stage, the second light-emitting device OLED2 is reversely biased, that is, the second light-emitting device OLED2 enters a negative half period of the AC driving, and the second light-emitting device OLED2 will stay in the negative half period during the light-emitting stage of the first light emitting unit. When the voltage for the negative half period comes, the remaining holes and electrons change their moving directions to move toward opposite directions, which is equivalent to consuming the remaining holes and electrons, thus diminishing the built-in field formed by the remaining carriers of the positive half period inside the second light-emitting device OLED2, further enhancing the carrier injection and recombination of the next positive half period, and finally improving the recombination efficiency. Moreover, the reverse bias process of the negative half period can "burn out" some microscopic small channels "filaments" turned on locally. Such a filament is actually caused by a kind of "pinhole". The elimination of the pinholes is very important for extending the usage life of the device. Therefore, the second light-emitting device OLED2 is in a recovery period during the light-emitting stage of the first light-emitting unit.

3. A charging stage of the second storage unit in which the second storage unit (the second capacitor C2) is charged The scan signal is at the high level and the charging unit is turned on. The light-emitting control signal is at the low level and the light-emitting control unit is turned off. The output voltage of the first voltage control unit becomes the low level from the high level and the output voltage of the second voltage control unit becomes the high level from the low level, so as to charge the second storage unit (the second capacitor C2).

Figure 6:
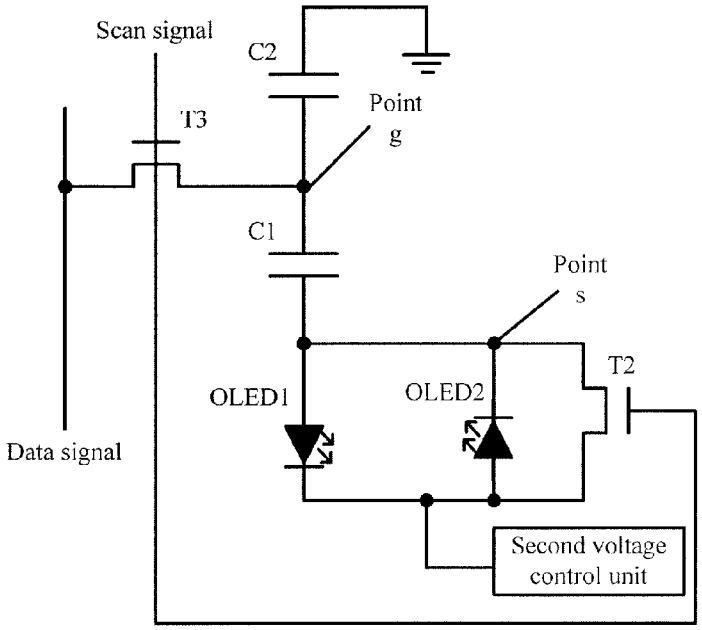
FIG. 6 is an equivalent circuit diagram for charging a second capacitor according to the present disclosure.

Referring to FIG. 2 and FIG. 3, the scan signal is at the high level, and the second transistor T2 and the third transistor T3 are turned on. The light-emitting control signal is at the low level, the first transistor T1 is turned off, and the driving transistor DTFT is also turned off. The output voltage of the first voltage control unit becomes the low level from the high level. The output voltage of the second voltage control unit becomes the high level from the low level. The data signal is a data voltage to charge the second capacitor C2. The equivalent circuit diagram for charging the second capacitor C2 at this stage is shown in FIG. 6.

The output voltage of the first voltage control unit jumps from the high level to the low level, and the output voltage of the second voltage control unit jumps from the low level to the high level. Since the second transistor T2 is turned on, the first light-emitting device OLED1 and the second light-emitting device OLED2 are short-circuited, and the voltage at the point s is at the high level. Since the first transistor T1 is turned off, no current flows through the driving transistor DTFT, and thus the voltage value provided by the first voltage control unit is the voltage value designed for the power supply. Therefore, the voltage difference between the two terminals of the second capacitor C2 after charged is not influenced by the internal resistance either. The voltage $V_{C2}$ between the two terminals of the second capacitor C2 is:

$$V_{C2}=V_{data}-V_{SS}.$$

4. A light-emitting stage of the second light-emitting unit in which the second light-emitting unit (the second light-emitting device OLED2) is controlled to emit light The scan signal is at the low level, and the charging unit is turned off. The light-emitting control signal is at the high level, and the light-emitting control unit is turned on. The output voltage of the first voltage control unit is at the low level and the output voltage of the second voltage control unit is at the high level, so as to make the second light emitting unit (the second light emitting device OLED2) emit light.

Figure 7:
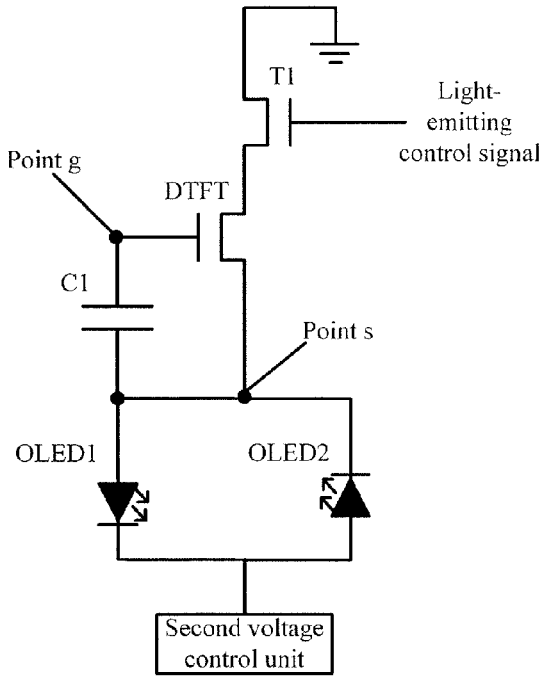
FIG. 7 is an equivalent circuit diagram for controlling a second light-emitting device to emit light according to the present disclosure.

Referring to FIG. 2 and FIG. 3, the scan signal is at the low level, and the second transistor T2 and the third transistor T3 are turned off. The light-emitting control signal is at the high level, and the first transistor T1 is turned on. The output voltage of the first voltage control unit is at the low level and the output voltage of the second voltage control unit is at the high level, so as to make the second light-emitting device OLED2 emit light. The equivalent circuit diagram for controlling the second light-emitting device to emit light at this stage is shown in FIG. 7.

The voltages of the first voltage control unit and the second voltage control unit remain unchanged. At this stage, the second light-emitting device OLED2 begins to enter a positive half period of the AC driving from this point, and will stay in the positive half period of the AC driving, i.e. the operating state, during the light-emitting stage of the second light-emitting unit. Since the gate of the driving transistor DTFT is at the floating state, as shown in the above, since the source and the drain of the driving transistor DTFT are interchangeable, as now shown in FIG. 2, the electrode of the driving transistor DTFT connected to the point s is used as the drain, the electrode of the driving transistor DTFT connected to T1 is used as the source, and thus the gate-source voltage of the driving transistor DTFT is the voltage between the two terminals of the second capacitor C2. Therefore, $$V_{gs}=V_{C2}=V_{data}-V_{SS}.$$

The driving current through the driving transistor DTFT, i.e. the light-emitting current $I_{oled2}$ of the second light-emitting device OLED2, is $$I_{oled2}=k_d(V_{gs}-V_{thd})^2=k_d(V_{data}-V_{SS}-V_{thd})^2$$

where $k_d$ is a constant related to the process and the driving design, and $V_{thd}$ is the threshold voltage of the driving transistor DTFT. The driving current is influenced by the data voltage and the threshold voltage of the driving transistor, which is a problem for the LTPS process with poor electric uniformity, but is not a main problem for the oxide thin-film field effect transistor TFT since the threshold voltages of the oxide TFTs are uniform and the threshold values of the oxide TFTs do not differ a lot for the oxide TFTs at all points.

In addition, for the first light-emitting device OLED1, beginning from this stage, the first light-emitting device OLED1 is reversely biased, that is, the first light-emitting device OLED1 enters a negative half period of the AC driving, and the first light-emitting device OLED1 will stay in the negative half period during the light-emitting stage of the second light emitting unit. That is, the first light-emitting device OLED1 is in a recovery period during the light-emitting stage of the second light-emitting unit.

Compared with the DC driving manner, the AC driving manner of the present disclosure has lots of non-comparable advantages. The present disclosure employs a circuit comprising two OLEDs connected reversely with each other to make the two OLEDs emit light alternately during two adjacent frames. In one frame, only one light-emitting diode emits light for display while the other one is reversely biased. When the next frame comes, the two OLEDs exchange their operating states. For each OLED, the light-emitting mechanism in the positive half period is identical with that of the forward DC driving, while the negative half period of the AC driving has very important effects. That is, after the positive half period, un-recombined holes (or electrons) accumulate at the hole transport layer/light-emitting layer interface (or the light-emitting layer/electron transport layer interface) of the OLED, but when the voltage for the negative half period comes, the remaining holes and electrons change their moving directions to move toward opposite directions, which is equivalent to consuming the remaining holes and electrons. Since the forward bias time and the reverse bias time are the same for any OLED, the AC driving of the OLED is completely realized, thus diminishing the built-in field formed by the remaining carriers of the positive half period inside the OLED, further enhancing the carrier injection and recombination of the next positive half period, improving the energy utilization efficiency, and finally improving the recombination efficiency. Moreover, the reverse bias process of the negative half period can "burn out" some microscopic small channels "filaments" turned on locally. Such a filament is actually caused by a kind of "pinhole". The elimination of the pinholes is very important for extending the usage life of the device.

Further, the circuit adjusts the power supply level during the data writing stage, such that no current flows through the driving circuit, and thus the power supply level for charging the storage capacitors reaches the design value. Therefore, the influence of the internal resistance of the lines on the light-emitting current is eliminated, and the display quality of pictures is improved.

Figure 8:
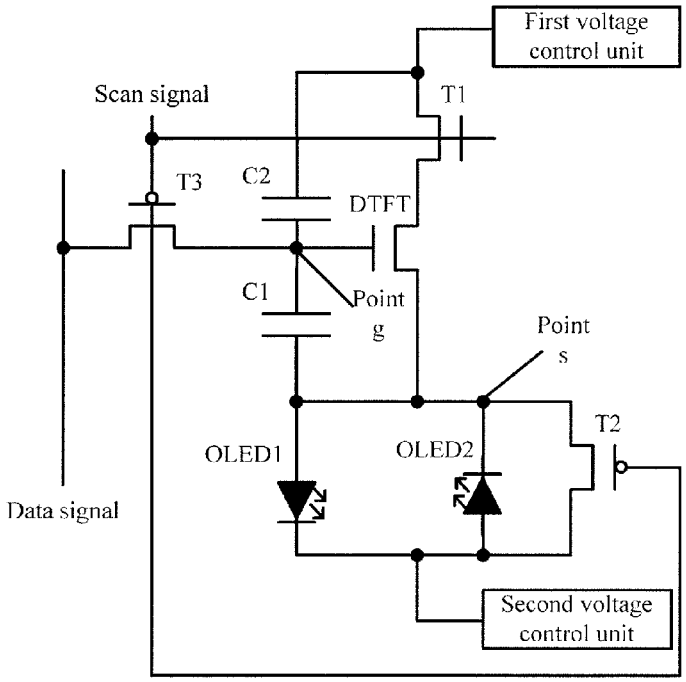
FIG. 8 is a diagram of another structure of the circuit of the present disclosure.
Figure 9:
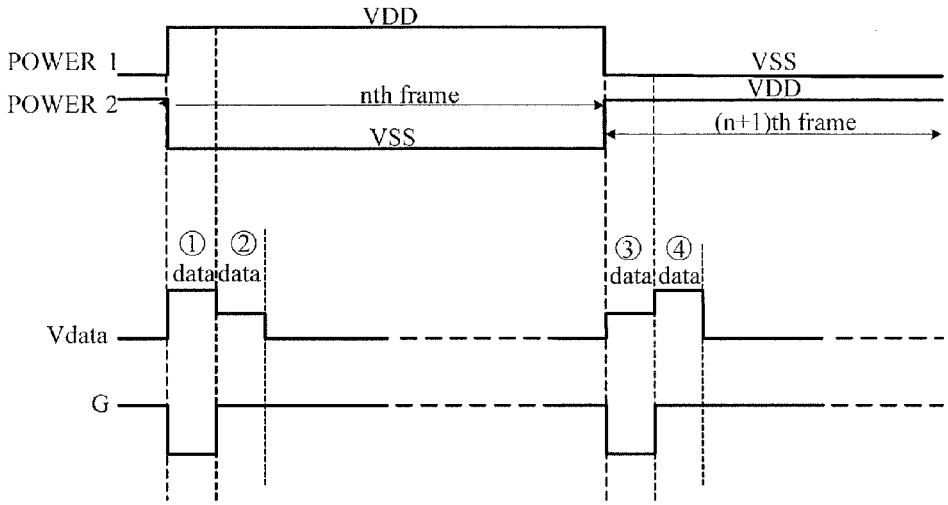
FIG. 9 is a timing chart of another structure of the circuit of the present disclosure.

In the present disclosure, there is also provided another alternative solution as shown in FIG. 8. Compared with the above solutions of the present disclosure, in the alternative solution, the second transistor T2 and the third transistor T3 are changed into P-type transistors, a light-emitting controller for generating the light-emitting control signal is omitted, and meanwhile only one scan signal is required in this circuit. FIG. 9 is the timing chart corresponding to FIG. 8. The operation of the circuit is identical with that of the main solutions.

Of course, the circuit can be easily changed into a P-MOS or CMOS circuit through simplification, replacement and/or combination, which falls in the scope of the present disclosure as long as it does not beyond the spirit of the present disclosure.

The display device described in the present disclosure can be an OLED display panel, an OLED TV, an OLED display, a cell phone, a pad, an electronic book, or the like.

The above implementations are only for illustrating the present disclosure, and in no way limit the scope of the present disclosure. It will be obvious that those skilled in the art may make various modifications and variations without departing from the spirit and scope of the present disclosure as defined by the following claims. Such equivalent technical solutions also fall within the scope of the present disclosure.

What is claimed is:

1. An OLED AC driving circuit comprising a light-emitting control circuit, a charging circuit, a driving circuit, a first storage circuit, a second storage circuit, a first light-emitting device, a second light-emitting device, a first voltage control circuit and a second voltage control circuit, wherein a first terminal of the light-emitting control circuit is connected to a first terminal of the driving circuit, a second terminal of the light-emitting control circuit is connected to the second storage circuit and the first voltage control circuit, and the light-emitting control circuit is configured to connect the first terminal of the driving circuit to the first voltage control circuit so as to control the first light-emitting device or the second light-emitting device to emit light under the control of a light-emitting control signal;

the charging circuit (T2, T3) is connected to the driving circuit, the first storage circuit, the second storage circuit, the first light-emitting device, the second light-emitting device and the second voltage control circuit, and is configured to short the anode and the cathode of the first light-emitting device (OLED1) and short the anode and the cathode of the second light-emitting device (OLED2) under the control of a scan signal, and to charge the first storage circuit (C1) or the second storage circuit (C2) under the control of the scan signal, a data signal, a first voltage control signal supplied from the first voltage control circuit and a second voltage control signal supplied from the second voltage control circuit;

a second terminal of the driving circuit is connected to a second terminal of the first storage circuit (C1), the first light-emitting device and the second light-emitting device, and the driving circuit is configured to drive the first light-emitting device or the second light-emitting device to emit light under the control of a signal at its control terminal, the first voltage control signal supplied from the first voltage control circuit and the second voltage control signal supplied from the second voltage control circuit;

a first terminal of the first storage circuit (C1) is connected to a control terminal of the driving circuit and a first terminal of the second storage circuit (C2), the second terminal of the first storage circuit (C1) is connected to the first light-emitting device, the second light-emitting device, the driving circuit and the charging circuit, and is configured to store the data signal or turn on the driving circuit;

a second terminal of the second storage circuit (C2) is connected to the first voltage control circuit and the driving circuit, and is configured to store the data signal or turn on the driving circuit;

the first light-emitting device (OLED1) has an anode connected to a second terminal of the first storage circuit (C1) and a cathode connected to the second voltage control circuit, and is configured to emit light under the control of the first voltage control circuit, the second voltage control circuit, the charging circuit and the driving circuit;

the second light-emitting device (OLED2) has a cathode connected to the second terminal of the first storage circuit (C1) and an anode connected to the second voltage control circuit, and is configured to emit light under the control of the first voltage control circuit, the second voltage control circuit, the charging circuit and the driving circuit;

the first voltage control circuit is connected to the second terminal of the light-emitting control circuit and the second terminal of the second storage circuit (C2), and is configured to supply power to the second storage circuit (C2) and the first light-emitting device; and the second voltage control circuit is connected to the charging circuit, the cathode of the first light-emitting device and the anode of the second light-emitting device, and is configured to supply power to the first storage circuit (C1) and the second light-emitting device.

2. The OLED AC driving circuit of claim 1, wherein the light-emitting control circuit comprises a first transistor having a gate configured to receive the light-emitting control signal, a source connected to the first voltage control circuit, and a drain connected to the driving circuit.

3. The OLED AC driving circuit of claim 2, wherein the driving circuit comprises a driving transistor having a gate connected to the first terminal of the first storage circuit and the first terminal of the second storage circuit, a source connected to the light-emitting control circuit, and a drain connected to the second terminal of the first storage circuit.

4. The OLED AC driving circuit of claim 3, wherein the charging circuit comprises:

a second transistor having a gate configured to receive the scan signal, a source connected to the drain of the driving transistor, and a drain connected to the second voltage control circuit; and a third transistor having a gate configured to receive the scan signal, a source configured to receive the data signal, and a drain connected to the gate of the driving transistor.

5. The OLED AC driving circuit of claim 4, wherein the first storage circuit comprises a first capacitor, and the first terminal of the first capacitor is connected to the drain of the third transistor and the second terminal of the first capacitor is connected to the source of the second transistor.

6. The OLED AC driving circuit of claim 5, wherein the second storage circuit comprises a second capacitor, and the first terminal of the second capacitor is connected to the gate of the driving transistor and the second terminal of the second capacitor is connected to the light-emitting control unit.

7. The OLED AC driving circuit of claim 6, wherein the light-emitting control circuit, the charging circuit and the driving transistor are N-type transistors or P-type transistors.

8. A display device comprising the OLED AC driving circuit of claim 1.

9. The display device of claim 8, wherein the light-emitting control circuit comprises a first transistor having a gate configured to receive the light-emitting control signal, a source connected to the first voltage control circuit, and a drain connected to the driving circuit.

10. The display device of claim 9, wherein the driving circuit comprises a driving transistor having a gate connected to the first terminal of the first storage circuit and the first terminal of the second storage circuit, a source connected to the light-emitting control circuit, and a drain connected to the second terminal of the first storage circuit.

11. The display device of claim 10, wherein the charging circuit comprises:

a second transistor having a gate configured to receive the scan signal, a source connected to the drain of the driving transistor, and a drain connected to the second voltage control circuit; and a third transistor having a gate configured to receive the scan signal, a source configured to receive the data signal, and a drain connected to the gate of the driving transistor.

12. The display device of claim 11, wherein the first storage circuit comprises a first capacitor, and the first terminal of the first capacitor is connected to the drain of the third transistor and the second terminal of the first capacitor is connected to the source of the second transistor; and the second storage circuit comprises a second capacitor, and the first terminal of the second capacitor is connected to the gate of the driving transistor and the second terminal of the second capacitor is connected to the light-emitting control unit.

13. The display device of claim 12, wherein the light-emitting control circuit, the charging circuit and the driving transistor are N-type transistors or P-type transistors.

14. A driving method of the OLED AC driving circuit of claim 1, comprising:

charging the first storage circuit;

controlling the first light-emitting device to emit light;

charging the second storage circuit; and controlling the second light-emitting device to emit light.

15. The driving method of claim 14, wherein said charging the first storage circuit comprises:

controlling the scan signal to be at a high level to turn on the charging circuit, and controlling the light-emitting control signal to be at a low level to turn off the light-emitting control circuit;

controlling the output voltage of the first voltage control circuit to become a high level from a low level and controlling the output voltage of the second voltage control circuit to become a low level from a high level, so as to charge the first storage circuit;

said controlling the first light-emitting device to emit light comprises:

controlling the scan signal to be at a low level to turn off the charging circuit, and controlling the light-emitting control signal to be at a high level to turn on the light-emitting control circuit;

controlling the output voltage of the first voltage control circuit to be at a high level and controlling the output voltage of the second voltage control circuit to be at a low level, so as to make the first light-emitting device emit light;

said charging the second storage circuit comprises:

controlling the scan signal to be at a high level to turn on the charging circuit, and controlling the light-emitting control signal to be at a low level to turn off the light-emitting control circuit;

controlling the output voltage of the first voltage control circuit to become a low level from a high level and controlling the output voltage of the second voltage control circuit to become a high level from a low level, so as to charge the second storage circuit;

said controlling the second light-emitting device to emit light comprises:

controlling the scan signal to be at a low level to turn off the charging circuit, and controlling the light-emitting control signal to be at a high level to turn on the light-emitting control circuit;

controlling the output voltage of the first voltage control circuit to be at a low level and controlling the output voltage of the second voltage control circuit to be at a high level, so as to make the first light-emitting device emit light.

* * * * *